US006648000B2

(12) United States Patent
Cain et al.

(10) Patent No.: US 6,648,000 B2
(45) Date of Patent: Nov. 18, 2003

(54) REEL SPOOL AND STAND ASSEMBLY FOR COILED TUBING INJECTOR SYSTEM

(75) Inventors: Troy D. Cain, Burleson, TX (US); Timothy Scott Steffenhagen, Ft. Worth, TX (US)

(73) Assignee: Varco I/P, Inc., Houston, TX (US)

( * ) Notice: Subject to any disclaimer, the term of this patent is extended or adjusted under 35 U.S.C. 154(b) by 69 days.

(21) Appl. No.: 10/039,464

(22) Filed: Nov. 9, 2001

(65) Prior Publication Data

US 2003/0089400 A1 May 15, 2003

(51) Int. Cl.[7] ..... B65H 75/34; E21B 19/22

(52) U.S. Cl. ..... 137/15.01; 137/315.01; 137/580; 137/355.2; 137/355.26

(58) Field of Search ..... 137/315.11, 315.01, 137/580, 15.01, 355.26, 355.2; 166/77.2

(56) References Cited

U.S. PATENT DOCUMENTS 4,471,799 A * 9/1984 Buck ..... 137/315
4,506,698 A * 3/1985 Garcia et al. ..... 137/355.26
4,586,676 A * 5/1986 Johnston et al. ..... 242/397.5
5,494,235 A * 2/1996 Vowles ..... 242/407
5,839,514 A * 11/1998 Gipson ..... 166/384

FOREIGN PATENT DOCUMENTS

WO WO 01/34934 A2 5/2001

* cited by examiner

*Primary Examiner*—A. Michael Chambers
(74) *Attorney, Agent, or Firm*—Marc A. Hubbard; Munsch Hardt Kopf & Harr, P.C.

(57) ABSTRACT

A spool for carrying continuous pipe or coiled tubing for a coiled tubing injector is dropped into a stand at a site and coupled to a rotary power source. The stand includes two axles, on either side of the spool, and a drive coupling. A pipe slideably extends through one of the axles. It is retracted when the spool is lowered onto the stand and then extended for communicating fluid between the coiled tubing and a fluid source. A swivel joint is connected to one end of the pipe. The pipe is permitted to turn with the spool or is held stationary with respect to the stand depending on whether the swivel joint is mounted outside the stand or inside the spool.

12 Claims, 9 Drawing Sheets

REEL SPOOL AND STAND ASSEMBLY FOR COILED TUBING INJECTOR SYSTEM

FIELD OF INVENTION

The invention pertains generally to coiled tubing reels used in conjunction with coiled tubing injectors for performing well servicing and coiled tubing drilling operations.

BACKGROUND OF THE INVENTION

Continuous pipe, generally known within the industry as coiled tubing since it is stored on a large reel, has been used for many years. It is much faster to run into and out of a well bore than conventional jointed straight pipe since there is no need to join or disconnect short segments of straight pipe.

Coiled tubing "injectors" are machines that are used to run continuous strings of pipe into and out of well bores. The injector is normally mounted to an elevated platform above a wellhead or is mounted directly on top of a wellhead. A typical coiled tubing injector has two contiguous chains. The chains are mounted on sprockets to form two elongated loops that counter rotate. The chains are placed next to each other in an opposing fashion. Tubing is fed between the chains. Grippers carried by each chain come together on opposite sides of the pipe and are pressed against it. The injector thereby continuously grips a length of the tubing as it is being moved in and out of the well bore. Examples of coiled tubing injectors include those shown and described in U.S. Pat. No. 5,309,900.

A coiled tubing reel assembly includes a stand for supporting a spool on which tubing is stored, a drive system for rotating the reel and creating back-tension during operation of the reel, and a "level winding" system that guides the tubing as it is being unwound from and wound onto the spool. The level winding system moves the tubing laterally across the reel so that the tubing is laid across the reel in a neat and organized fashion. The coiled tubing reel assembly must rotate the spool to feed tubing to and from the injector and well bore. The tubing reel assembly must also tension the tubing by always pulling against the injector during normal operation. The injector must pull against the tension to take the tubing from the tubing reel, and the reel must have sufficient pulling force and speed to keep up with the injector and maintain tension on the tubing as the tubing is being pulled out of the well bore by the injector. The tension on the tubing must always be maintained. The tension must also be sufficient to wind properly the tubing on the spool and to keep the tubing wound on the spool. Consequently, a coiled tubing reel assembly is subject to substantial forces and loads.

Tubing reel assemblies are typically transported to wells with the required coiled tubing wound on the spool, and the spool installed in the reel assembly. Such spools are specially designed for the particular reel assembly and not meant to be disconnected or removed from the reel assembly during normal operation. A second reel assembly would therefore also have to be sent if there was need for a different diameter tubing or in the event that replacement tubing was required. Alternately, if replacement tubing was required, a shipping spool could be used to transport replacement tubing to the well. A lightweight spooling stand would then have to be used to support the shipping spool to transfer the tubing onto the spool of the working reel assembly. To save weight and size, these shipping spools do not possess the structure necessary to handle the loads typically imposed on reels during coiled tubing operations. Rather, shipping spools are designed as a relatively inexpensive means of transporting the tubing from a factory to a well. Therefore, transferring tubing from the shipping spool to the working reel assembly is necessary.

Transferring tubing from a shipping spool to a working reel induces extra strain in the tubing as it is unwound from the shipping spool then rewound onto the working spool. Since metal tubing is plastically deformed during spooling, transferring coiled tubing from a shipping spool to a working reel assembly reduces the life or number of hours that the tubing can be used, thus increasing the cost of coiled tubing operations. Furthermore, transfers typically involve spooling 20,000 to 25,000 feet of tubing at rates of 100 to 200 feet per minute. Therefore, considerable time is required to complete a transfer.

There exist coiled tubing reel stands for receiving common and ordinary shipping spools for use as working reels. These tubing reel assemblies require inserting a shaft through the center of the spool, and inserting a pair of driving knobs, mounted to a drive plate on the stand, into the side of the spool to provide the connection for the drive system. As a consequence, this type of reel stand has several problems. First, the reel stand either has to be separable into two halves so that the sides of the stand can be moved laterally away from each other, or has to have the sides of the stand capable of being swung outwardly, in order to allow the shipping spool of tubing to be loaded on the stand. Second, the spool has to be carefully aligned with the drive system on the stand. Spools wound with tubing are very large and heavy, weighing 30,000 to 60,000 lbs. on average. They are cumbersome and difficult to maneuver. Consequently, aligning a spool and the drive system on a rocking ship or in high winds is a difficult task. Third, as previously mentioned, standard and ordinary shipping spools are not built to handle the substantial loads encountered by a typical working spool.

SUMMARY OF THE INVENTION

Many of these problems are addressed by using a working spool that is removably mounted to a stand. The spool is supported on a stand by a pair of axles. A drive coupling, which is preferably formed when the spool is lowered onto the stand, transmits rotational motion to the spool. However, such a spool and stand assembly can be subject to several problems, one of which is caused by the fact that fluid used in drilling and workover operations is supplied to the coiled tubing under very high pressure. Passing the fluid through a bore created in an axle stresses the axle and a hub or other structure to which the axle is connected. To solve this problem, coiled tubing on a removable spool is coupled to a fluid source by a fluid conduit that extends through a bore in the axle. Stress created by the fluid pressure is not transferred to the axle and the structure supporting the axle, thereby avoiding having to reinforce the structure to which the axle is connected.

It is preferred that a relatively short fluid conduit, which will be referred to as a pipe, is passed through a bore in one of the two axles to connect the coiled tubing on the spool to a fluid source. The pipe is withdrawn at least far enough to provide enough clearance to allow the spool to be loaded onto the stand, and then extended so that it extends across a coupling of the spool to the stand. A swivel joint is coupled to one of the pipe's two ends. If one side of the swivel joint is coupled to the end of the pipe that is inside of the spool, the other side of the swivel joint is coupled to the coiled tubing, and the end of the pipe outside the stand is coupled to the fluid source. In this configuration, the pipe remains stationary with respect to the stand when the spool rotates. If the swivel joint is coupled to the end of the pipe outside the spool, the coiled tubing is coupled to the opposite end of the pipe and the fluid source is then coupled to the swivel joint opposite the pipe. The pipe rotates with the spool when the swivel joint is mounted outside the spool. If desired, the swivel joint may be permitted to be attached at either end of the pipe, giving the option of having the swivel joint placed either inside the spool or outside the stand.

DETAILED DESCRIPTION OF DRAWINGS

In the following description of a preferred embodiment, like reference numbers refer to like parts.

Figure 1A:
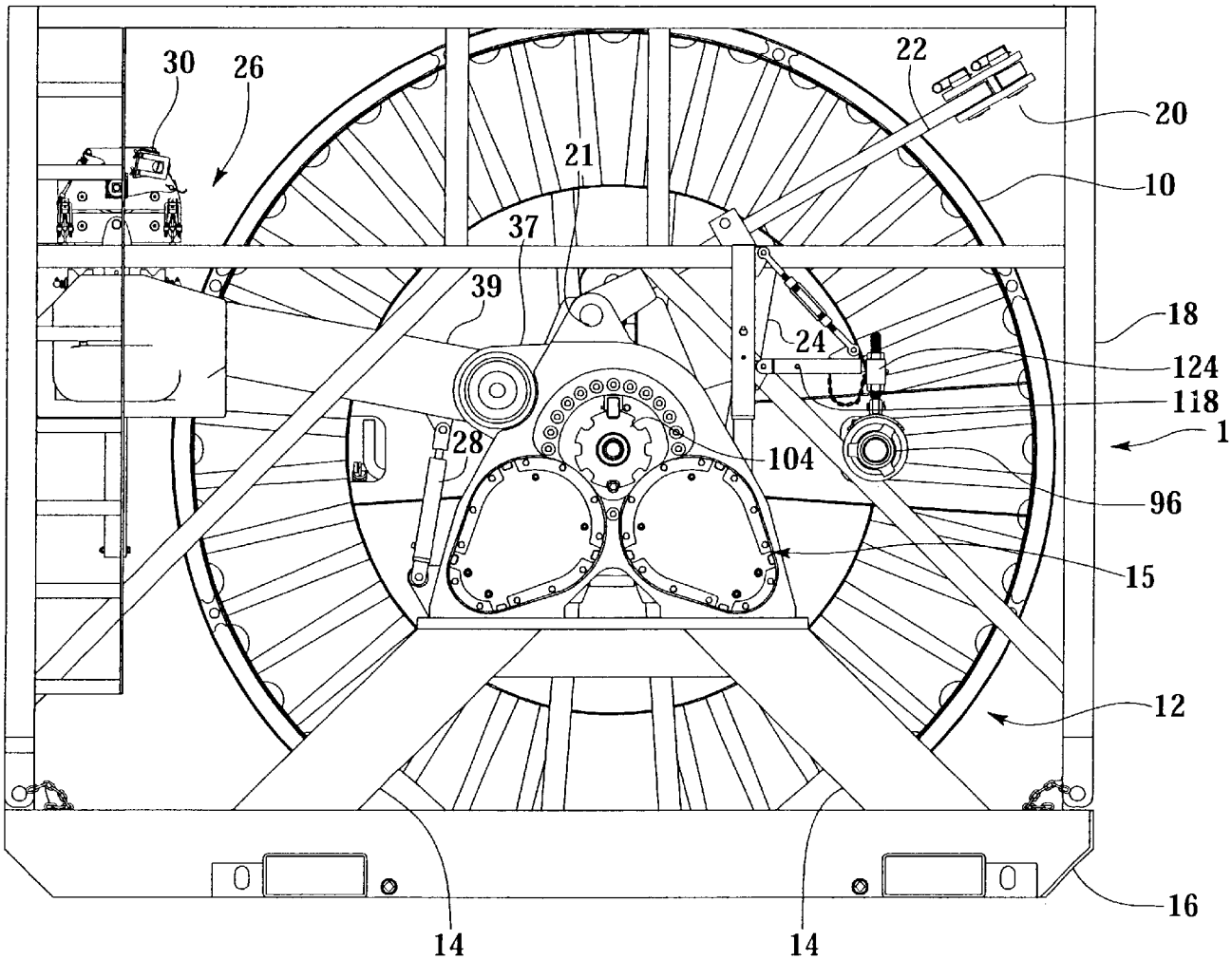
FIG. 1A is a side view of a reel assembly, including a spool and stand combination, for a coiled tubing injector.
Figure 1B:
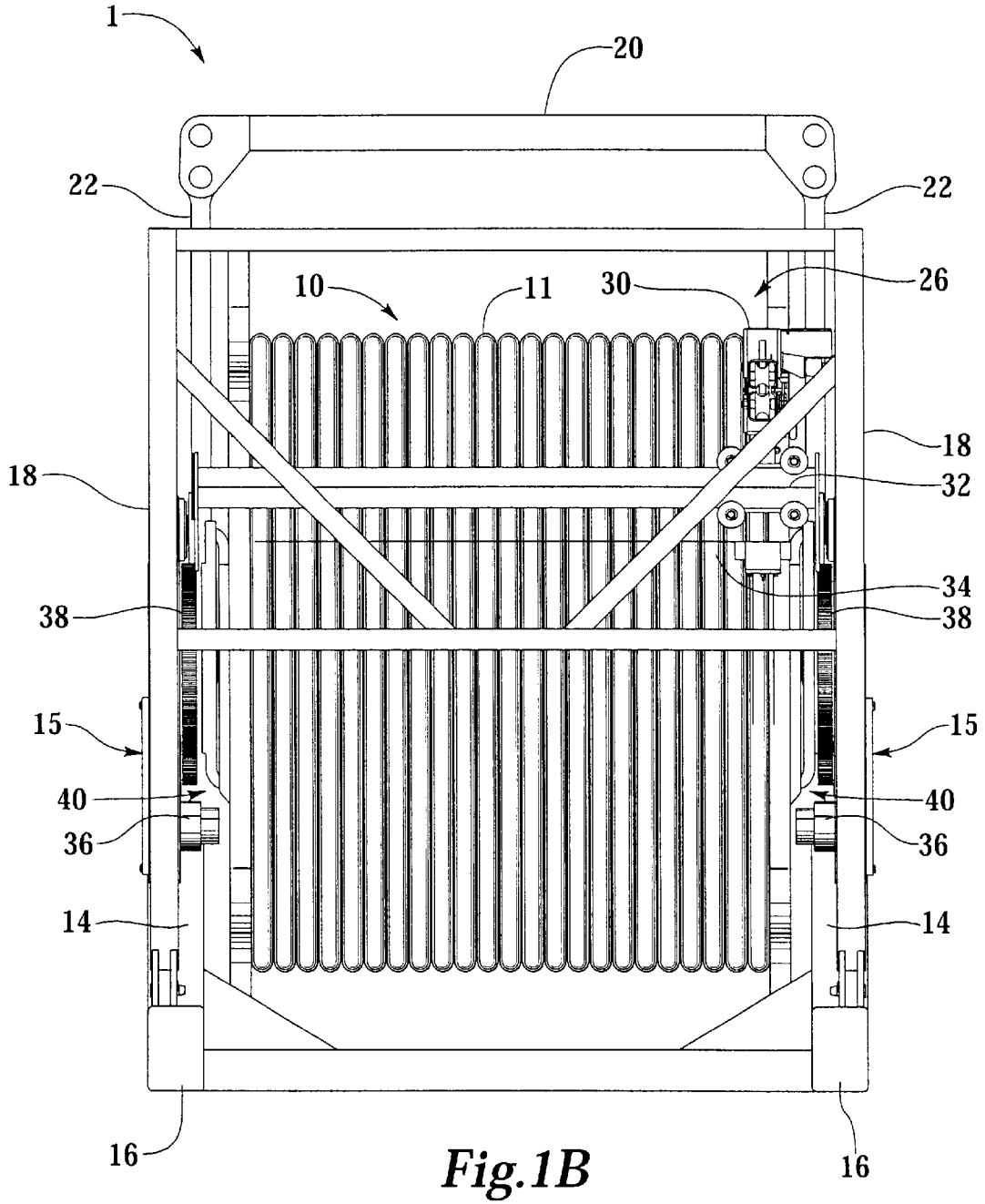
FIG. 1B is an end view of the reel assembly of FIG. 1A.
Figure 7:
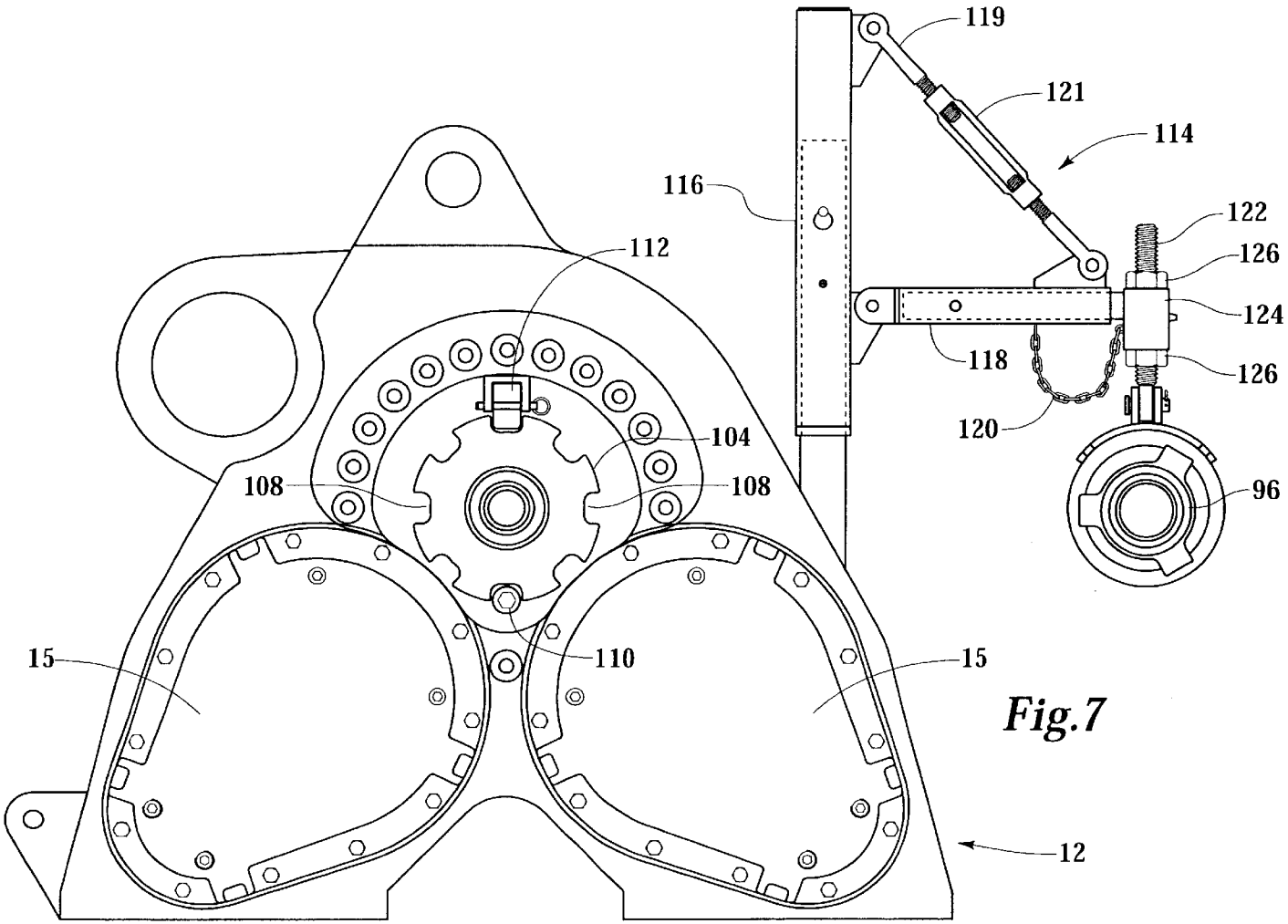
FIG. 7 is a side view of the stand of the reel assembly of FIGS. 1A and 1B.

Referring to FIGS. 1A, 1B and 7, tubing reel assembly 1 includes coiled tubing spool 10. Coiled tubing 11 is wound on the spool. The spool is mounted for rotation on a stand that is generally designated as 12. The stand also imparts rotational motion to the spool through a drive coupling. The stand may be of any configuration. The illustrated stand is intended to be representative only. In the illustrated embodiment, the stand includes legs 14 and a gear housing 15. Inside each gear housing is a transmission that transfers rotational power from one of two motors 36 (only one visible) to one half of drive coupling 40. The stand also supports a pair of axles, which are not visible in these views. An "axle" refers to a supporting member that carries a spool, and that either rotates with the spool to transmit power to it or allows the spool to rotate freely on it. It can take the form of a pin, shaft, bar, beam or spindle, for example. The axles support the spool as it rotates. The axles may instead be mounted on spool 10 rather than the stand. It is preferred to mount the stand on skids 16 so that it can be easily transported. A removable cage frame 18 protects the stand and spool, but is open at the top to allow the spool to be lowered onto the stand. A spreader bar 20 for hoisting the stand and for raising and lowering the spool onto the stand is shown attached to the top of stand 12 at eyelets 21. The legs 22 of the spreader bar pivot to allow the bar to be moved out of the way during operation of reel assembly. Each leg is supported by an arm 24, which is attached to the leg by means of a sliding clamp.

A level winding mechanism 26 is also pivotally attached to the stand through a pair of support arms 39. Hydraulic cylinder 28 supports and pivots the arm of the level wind mechanism. Level wind mechanisms are well known, and this is but one example. Coiled tubing is fed through a carriage 30 mounted on a track 32 for traversing across the spool as it rotates. As the carriage moves, it causes the coiled tubing to wind neatly on the reel. The carriage also supports the tubing as it unwinds. The carriage is powered by rotary screw 34 that is coupled to drive unit 15 of the stand through timing gear 37. The timing gear 37 meshes with drive gear 38 to synchronize the level wind mechanism with the rotation of the spool. Timing gear 37 turns a first sprocket (not visible) mounted on the same shaft as the timing gear. A chain is mounted on the first sprocket and a second sprocket (not visible) that turns rotary screw 34, extending within one of two support arms 39.

Rotational power is supplied by at least one motor. In the preferred embodiment, two low profile hydraulic motors 36 (only one is visible) are placed inside the stand to reduce the profile or overall width of the stand, taking advantage of the clearance between the spool and the stand necessary to accommodate a rigid rotary coupling for applying rotational power to the spool. Each motor delivers power to main gear 38 through a transmission, which is preferably comprised of a reduction gear train contained in sealed gear housings 15. The main gear 38 is coupled to the spool through a rigid drive coupling that transfers rotational power to the spool. A preferred embodiment of this coupling is designated 40 in the figures.

Figure 2:
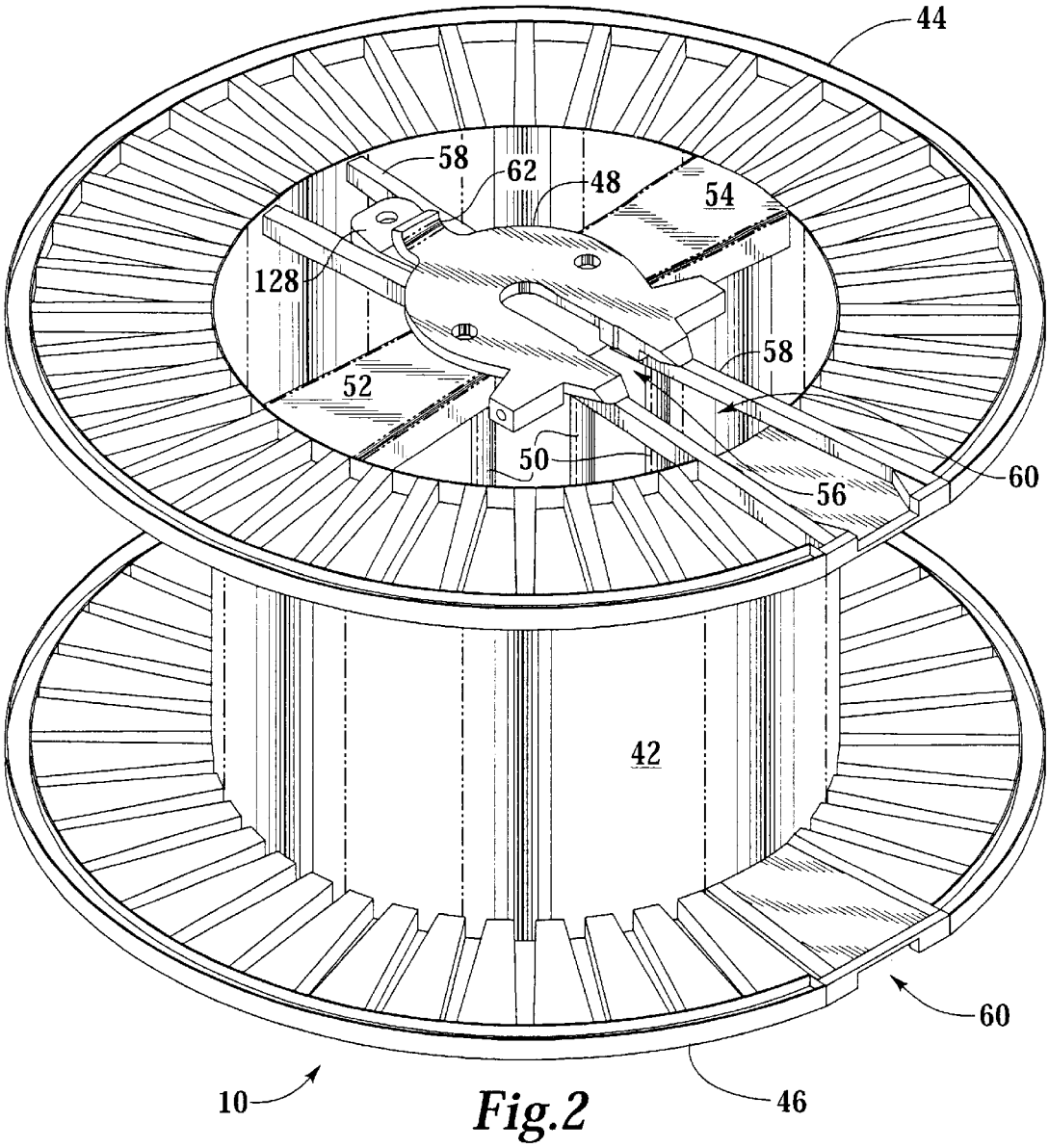
FIG. 2 is a perspective view of a spool for coiled tubing.

Referring to FIG. 2, spool 10 is a representative example of a preferred embodiment of a spool that may be used with the invention. It has a drum 42, a right rim 44 and a left rim 46. The rims are attached at opposite ends of the drum. The spool has central hubs on opposite sides for supporting the spool for rotation with respect to the stand. The hubs, in a preferred embodiment shown in the figures, are preferably each comprised of a hub plate 48 (only one is visible in this view). The hub plates are supported by a plurality of central support members 50 that extend generally parallel to, and are arrayed around, the axis of the spool. The hub plates are also supported by radial support members 52, 54 and 58 at each end of the drum. Each plate 48 preferably has defined in it an elongated slot 56.

Figure 3:
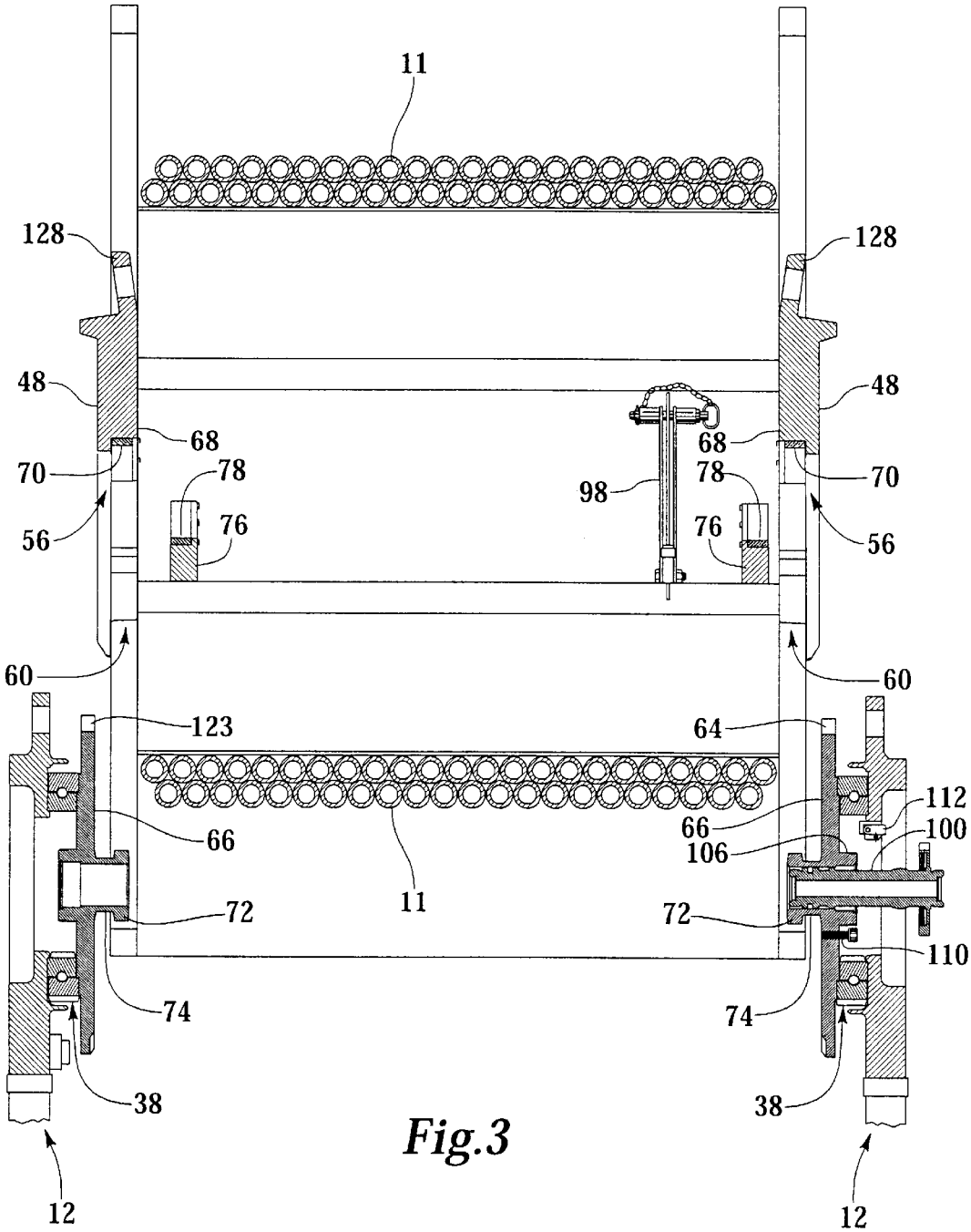
FIG. 3 is a sectioned end view of the reel assembly of FIG. 1A.
Figure 4B:
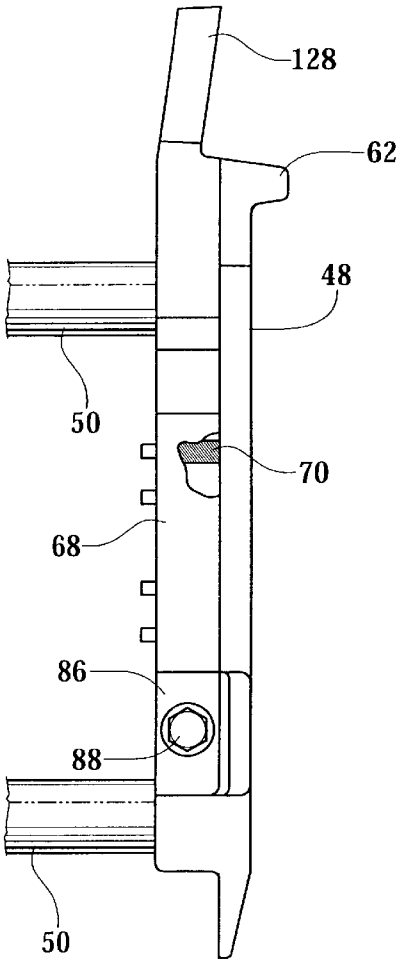
FIG. 4B is a side view of the catch of FIG. 4A.
Figure 4A:
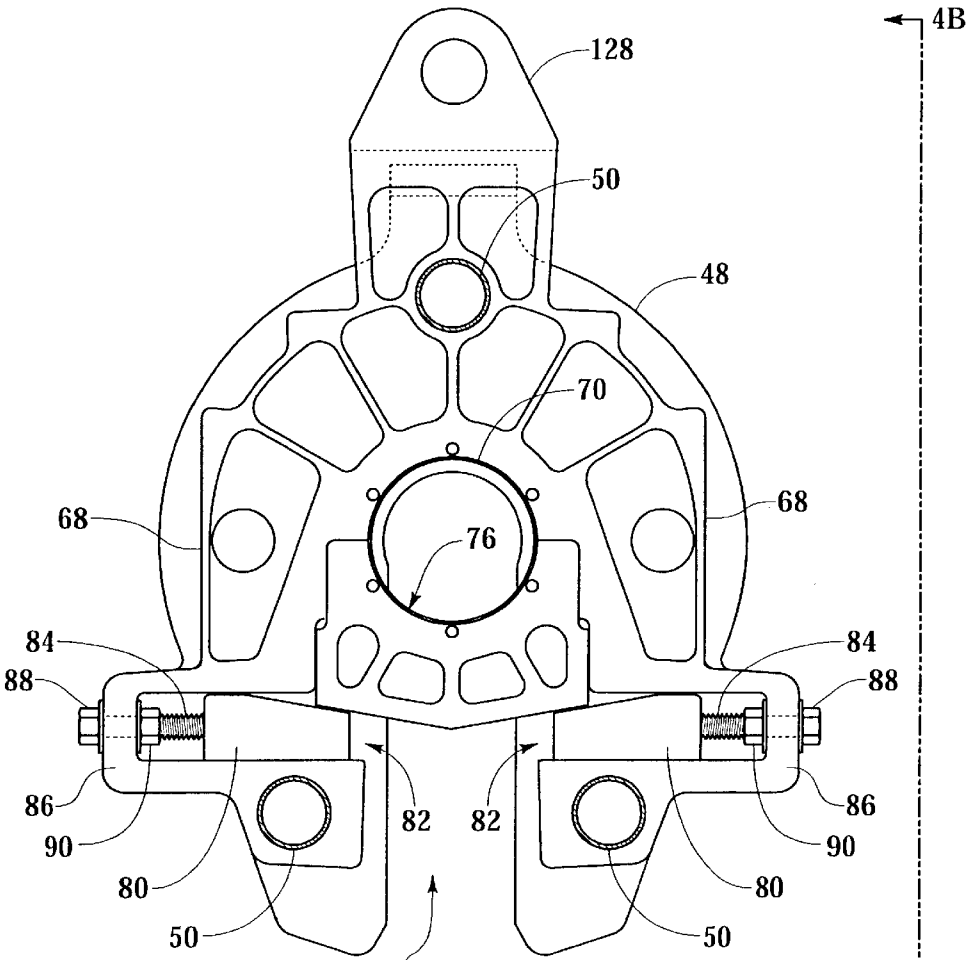
FIG. 4A is a plan view of a catch mounted inside the spool of FIG. 2.

Referring to FIGS. 2 and 3, each slot 56 receives an end of an axle 74 extending from the spool stand 12 as the spool is lowered onto the stand. The slot guides the axle as the spool is being lowered. A pair of radial support members 58 define a channel 60 on each side of the spool that is aligned with slot 56 on that side of the spool. The channel, which is defined on the side of the spool, provides additional clearance to receive the free end of each axle of the stand. Use of the channel allows the spool and stand to have a narrower profile. However, drive hub plates 48 could be made to stand further away from the side of the spool to avoid having the channel, but at the expense of increased width. The closed end of the slot rests on top of the axle when the spool is fully lowered. The plate thus forms a collar-shaped structure for supporting the spool on an axle. The slot is closed once the spool is fully lowered onto the stand. The end of the axle could be supported by a hub having a structure different from that of the plate. However, use of a plate is preferred as it provides a relatively smooth surface that may slide against a drive plate on the stand, thereby preventing the spool from moving from side to side as it is being lowered into the stand. Furthermore, one or both plates may support a coupling member for use in transmitting rotational power to the spool from the stand at a position that provides greater leverage as compared to, for example, a coupling of the axle to a complementary member on the spool.

In the preferred embodiment, each plate 48 includes a coupling member in the form of a tab 62 that slides into a corresponding slot 64 on a complementary drive plate 66. Each tab and slot acts as a coupling for transferring rotational power from the stand's drive plate to the spool. Although the figure shows a coupling on each side of the spool, only one is required. The stand's drive plates may also have a complementary tab, which is not shown, that slides into slot 56. Drive plate 66 is mounted on stand 12 so that it can be rotated. As the spool is lowered onto the stand, tab 62 on plate 48 slides into slot 64. The engagement of a tab with a corresponding slot provides a rigid rotational coupling for transmitting torque to the spool. Each plate 48 will also be referred to as a drive plate for this reason. The two plates comprise the drive coupling 40 of FIG. 1B.

A rigid coupling is desirable for controlling the spool and synchronizing the turning of the spool with the injector. If the rate of unwinding the coiled tubing does not match the rate at which the injector is operating, additional strain will be placed on the tubing. Each tab is axially displaced from the axis of the spool in order to increase leverage and thus provide better control. This particular coupling arrangement has an advantage that no movement of coupling members is required after the spool is lowered. It is also self-aligning. Alternate couplings are possible and could be substituted, but possibly with the loss of certain advantages of the preferred embodiment. For example, an axle could have a key that fits in a spline formed at the close of slot 56 in each plate 48, or vise versa. However, such an arrangement will tend to provide less leverage. Furthermore, substantial shearing forces on the key due to the large mass of the spool and the rotational forces applied to it could cause deformation and failure. An axle also could be shaped to fit a socket formed at the end slot, for example, like a wrench that fits a bolt head. Again, such an arrangement provides less leverage and is subject to being deformed more easily by rotational forces applied to it. A pin or bolt could be inserted through drive plate 48 or other member on the spool and a corresponding drive member on the stand to make the fixed coupling. However, this type of coupling requires manual assembly that would slow down changing a spool. A pin or other type of member that is spring-loaded to automatically extend when the spool is lowered could be used but requires additional clearance, resulting in a wider stand.

The spool includes two eyelets 128 for attaching vertical legs 22 from the spreader bar 20 (See FIGS. 1A and 1B) to lower and lift the spool.

Referring now to FIGS. 3, 4A, 4B, 5 and 6, once the spool is lowered onto the stand, the opening of the slot 56 must be closed to prevent the spool from falling off the axles of the stand once it rotates. Although many different types of structures can be used as a catch, a preferred embodiment includes a body 68 having a semi-circular support collar 70 for receiving head 72 of axle 74. Preferably, collar 70 includes a bushing with a wear-resistant surface. Once axle 74 enters and sits within the support collar 70, a latch piece 76 is put into place to trap the axle (not shown). Although the axle does not in the preferred embodiment, rotate with respect to the spool, there will be some relative movement. As the entire weight of the spool rests on the axles, significant wear is possible. Thus, it is preferred to have replaceable wear surfaces. Although not shown, the latch piece includes portions that slide within channels in the catch body 68 to constrain the latch to movement within the plane of the body of the catch once it is installed after the axle moves through the slot 56. The latch piece includes a second, semi-circular bushing 78 that provides a wear resistant surface for trapping the axle. Wedges 80 are moved inwardly within channels 82 to push the latch piece snuggly against lands formed on either side of the collar 70, thereby forming a closed bushing for supporting the axle. Rods 84 extending through clearance openings in end walls 86 that partly define channels 82 of the catch assembly. The rods are used to move the wedges inwardly and outwardly. The end of each of the rods is threaded and screws into a threaded bore formed in each of the wedges. Nuts 88 and 90 are welded to each of the threaded rods, on opposite sides of wall 86, and hold them in place as they are being turned to move the wedges in and out.

Figure 5:
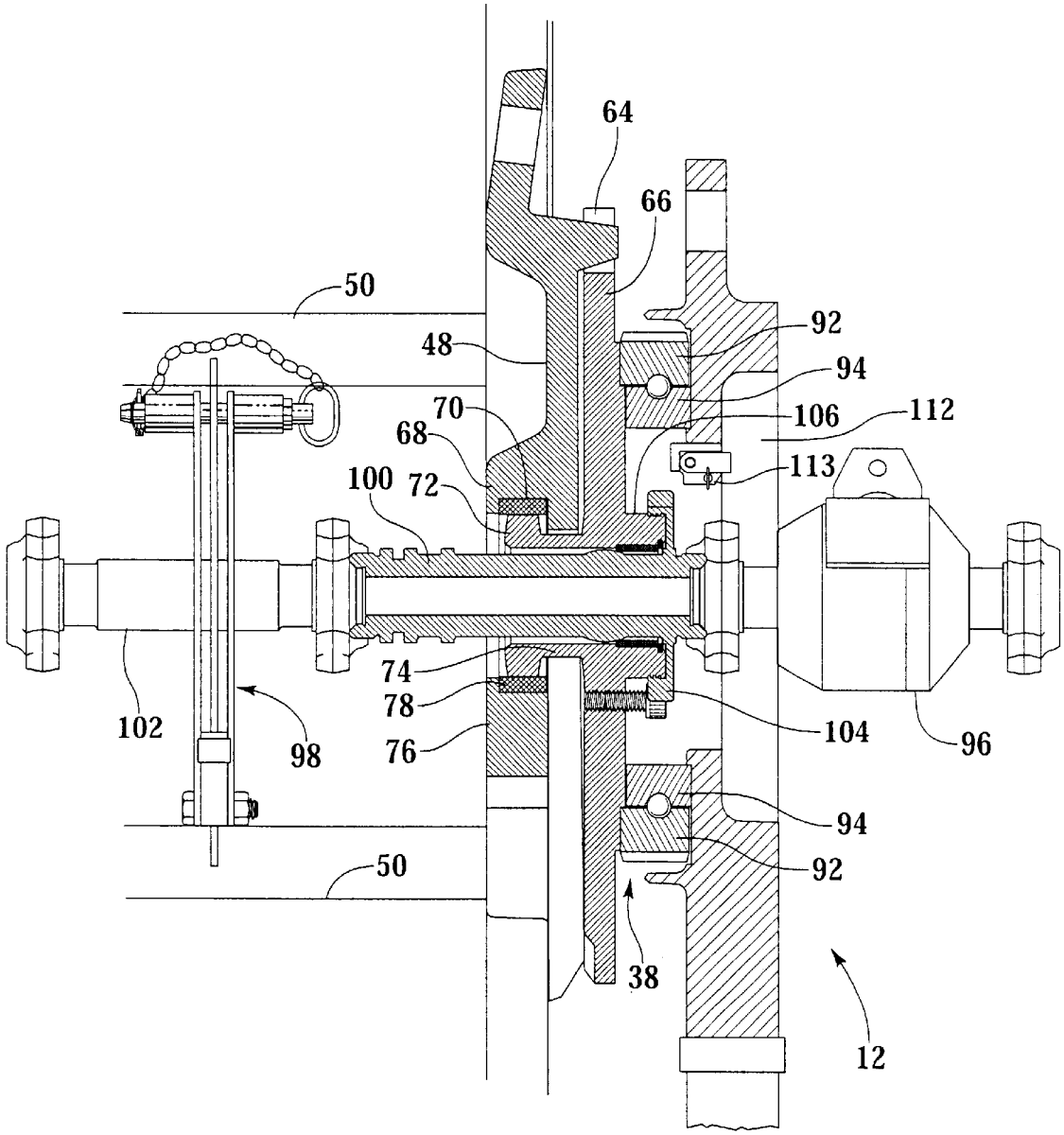
FIG. 5 is a section through a portion of the reel assembly of FIGS. 1A and 1B in a second configuration.
Figure 6:
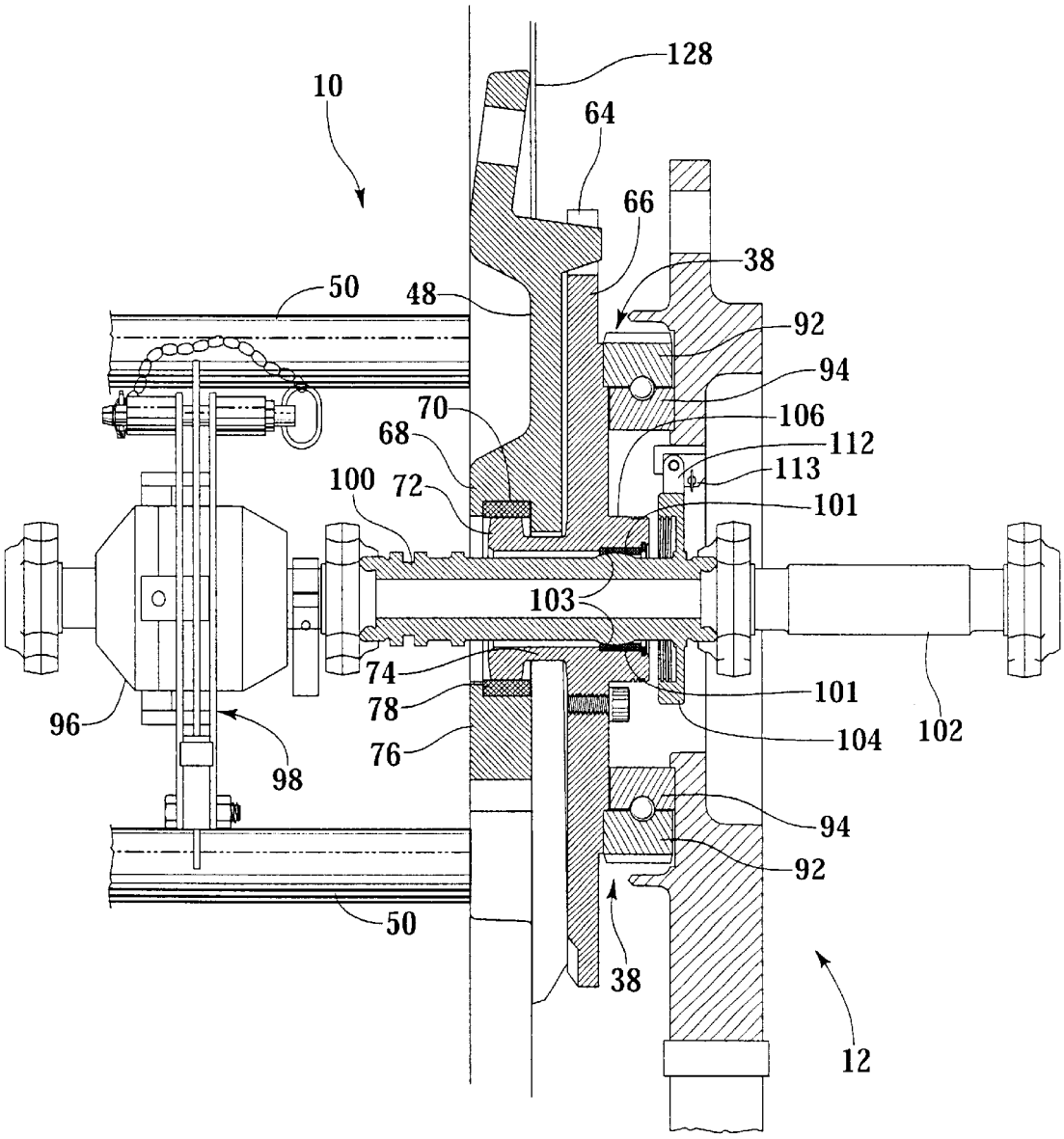
FIG. 6 is a section through a portion of the reel assembly of FIGS. 1A and 1B in a first configuration.

Referring now to FIGS. 3, 5 and 6, at least one output gear, which is not shown, of the one or more transmissions housed within drive unit 15 (not visible) of stand 12 meshes with primary gear 38. Gear 38 takes the form, in the preferred embodiment, of teeth formed on the exterior of outer race 92 of ball bearing assembly. Inner race 94 of the ball bearing assembly is connected to the stand 12. Drive plate 66 is connected to the outer race 92. Axles 74 are mounted through drive plates 66 and turn with the drive plates. Thus, there is no bearing between the spool 10 and the axle 74.

A coupling for carrying fluid between coiled tubing 11 and an external plumbing system for handling fluids must accommodate relevant rotation of the spool and stand. This coupling may be used on either side of the stand. The coupling includes a swivel joint, which includes two short pipes joined in a manner that permits relative rotation of the two pipes while communicating the fluid from one pipe to the other. FIGS. 5 and 6 illustrate swivel joint 96 as used in two modes of operation or configurations in a preferred embodiment: one with the swivel joint outside stand 12, as shown in FIG. 5, and one with the swivel joint mounted in the center of spool 10 by bracket mounting 98. It is preferred, but not necessary, for both modes of operation to be accommodated. A short length of pipe 100 couples the swivel joint, when it is mounted outside the spool, to the coiled tubing or, when it is inside the spool, to a fluid source or drain. In either case, pipe 100 may be coupled through additional pipe, such as extension pipe 102. When the swivel is mounted externally to spool 10, as shown in FIG. 5, extension pipe 102 extends the connection to the coiled tubing past bracket 98. In the external position of FIG. 6, pipe 102 provides a coupling in the same approximate position as the coupling on the swivel joint when it is located outside the stand. Conventional fittings are used to connect the pipes and the swivel joint.

Pipe 100 is slidable within a hollow bore formed through the center of one of the axles 74. The pipe 100 in FIG. 3 is in a retracted position. It is placed in the retracted position, which position also includes it being fully removed from the bore hole if desired, when spool 10 is being lowered onto stand 12, as shown in FIG. 3. Once the spool is mounted to the stand, pipe 100 is pushed so that it extends across the coupling of the stand and reel, with one end of the pipe located inside the spool and the other end of the pipe located outside the stand. This position, when the pipe extends across the coupling, will be generically referred to as the extended position.

In a preferred embodiment, which provides an option on where swivel joint 96 is located, pipe 100 is pushed into one of two extended positions, depending on where the swivel joint 96 is located. In the configuration shown in FIG. 5, in which the swivel joint is outside spool 10, the pipe rotates with the spool and relative to stand 12. To cause pipe 100 to rotate with the spool, it is preferably coupled in some manner with a rotating member on the stand. In the configuration shown in FIG. 6, in which the swivel joint is located inside spool 10, the spool rotates relative to the pipe, and the pipe does not rotate with respect to stand 12. The pipe is coupled to a part or element on the stand that does not rotate. This coupling can be made by any structure or mechanism that prevents relative rotation. The connection is preferably releasable if it would otherwise interfere with retraction of pipe 100 during lowering of the spool. To support the pipe within the bore of axle 74 for rotation, a journal bearing is formed by bearing surface 101 disposed around the inside surface of the axle bore and a journal comprised of a bulge or shoulder 103 formed around pipe 100. The entire pipe rotates within the bore, supported by this journal toward one end and swivel joint 96 at the other end, thus avoiding having the entire length of the pipe resting against the inside surface of the axle bore.

Referring now also to FIG. 7 in addition to FIGS. 5 and 6, pipe 100 includes, in a preferred embodiment, a collar 104 located near one end of the pipe. An inside surface of the collar is preferably threaded so that it can be screwed onto a threaded shoulder 106 that extends from the rear of plate 66 and surrounds the bore hole through the center of axle 74. In FIG. 5, threading collar 104 onto shoulder 106 connects the pipe to plate 66, thereby causing the pipe to rotate with the plate. The threaded connection fixes both the axial position of the pipe and its angular rotation with respect to plate 66. Retaining the pipe against axial movement is preferred when the swivel joint 96 is in the position shown in FIG. 5. When it is in the position shown in FIG. 6, bracket 98 prevents the swivel joint, and thus also pipe 100 and extension pipe 102, from moving along their respective axes. The collar includes at least one, and preferably a plurality, of notches 108 formed around its perimeter. These notches may be used to rotate the collar and thread it onto shoulder 106. They may also be used to interfere with elements mounted either to plate 66 or to stand 12 and thereby rotationally coupling the collar to either of these elements. When configured as shown in FIG. 5, threaded bolt 110 is backed out into one of the notches 108 to prevent the collar from turning off of shoulder 106. When configured as shown in FIG. 6, collar 104 is not screwed onto shoulder 106. Hinged tab 112, which is mounted on stand 12, is pivoted from a non-interfering position shown in FIG. 5 to an interfering position shown in FIG. 6. In the interfering position, the tab falls into one of the notches 108 and prevents the pipe from rotating with respect to stand 12. Pin 113 extends through a clevis in which the pivoting tab is mounted and holds the tab in either position. Mounting swivel joint 96 in bracket 98 prevents axial movement of pipe 100 relative to the tab. Although the collar is advantageous, as it is useful in coupling the pipe to the stand to either rotate or remain stationary, other mechanisms could be used.

Referring now only to FIGS. 1A and 7, when it is preferred to use swivel joint 96 outside of a spool, in the manner shown in FIG. 5, hoist 114 is used to hold the swivel in a stowed position, as shown in these figures, and in an operating position, as shown (with hoist 114) in FIG. 5. The hoist is rotated to swing the swivel joint between the two positions. The hoist is preferably comprised of adjustable post 116, which is comprised of an outer tube that slides over an inner post, and an extendable boom 118, which is similarly comprised of an outer tube that slides over an inner tube. Diagonal brace 119, comprised of two threaded rods joined by turn buckle 121 to adjust its length, supports or holds the boom in position. Chain 120 prevents the inner tube from extending too far. The swivel joint is pivotally attached to one end of screw 122. The screw is mounted through a collar 124 and held in place by a couple of nuts 126 located on opposite sides of the collar. The screw may be rotated, raised and lowered.

Figure 10:
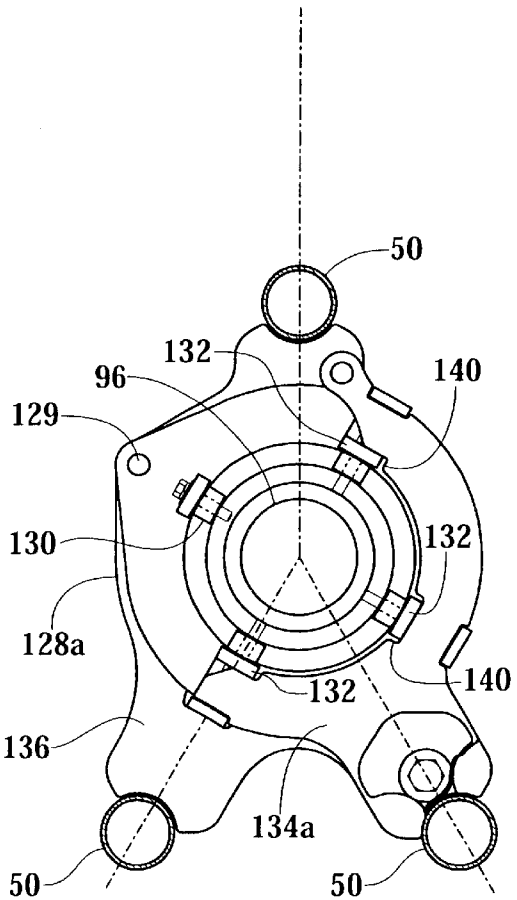
FIG. 10 is a plan view of the closed bracket of FIG. 9.
Figure 9:
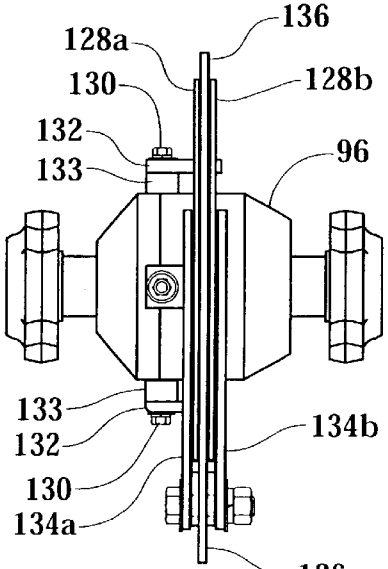
FIG. 9 is a side view of the bracket of FIG. 8 in a closed position, with the swivel joint installed.
Figure 8:
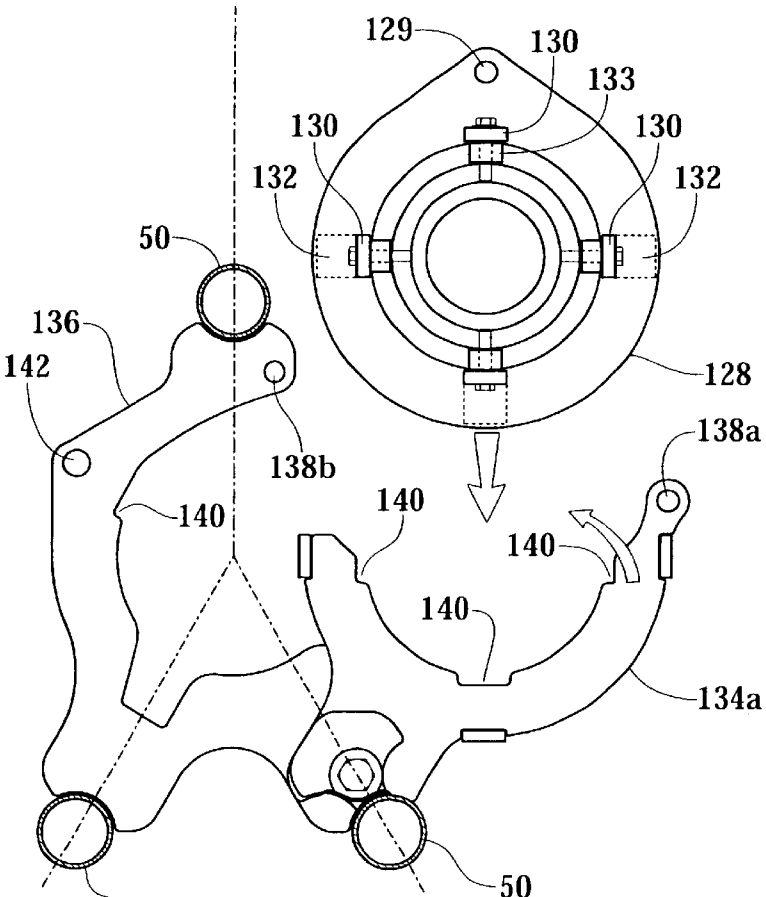
FIG. 8 is a plan view of a bracket in an open position for holding a swivel joint in the center of a coiled tubing spool.

FIGS. 8, 9 and 10 illustrate a process for installing swivel joint 96 in bracket 98 (see FIG. 6). The swivel joint is held in the center of a mounting collar, which is generally designated 128. The mounting collar is preferably comprised of two, spaced-apart sheets of material 128*a* and 128*b*. The mounting collar includes an eyelet 129 so that it can be hoisted into position. Screws 130, each mounted through an angle iron 132 and a spacer 133, hold the swivel joint in position. A base segment of each angle iron separates the two sheets 128*a* and 128*b* of the mounting collar. Bracket 98 has two halves, 134 and 136, that pivot with respect to each other between an open position shown in FIG. 8, and a closed position shown in FIGS. 9 and 10. Bracket half 134 pivots and the other bracket half 136 is attached by welding or other means to support members 50 of spool 10 (see FIG. 3). Bracket half 134 is made of two, spaced-apart sheets that are designated 134*a* and 134*b*. Swivel joint 96 is lowered into bracket half 134, where the two sheets 128*a* and 128*b* of collar 128 sit just inside and between the two sheets 134*a* and 134*b* of bracket half 134. Bracket half 134 is then pivoted into bracket half 136, with bracket half 136 fitting between sheets 128*a* and 128*b* of collar 128. The two bracket halves are preferably held together by a releasable pin (not shown in these views) extending through openings 138*a* and 138*b*. To prevent the swivel joint from rotating within the bracket, upright segments of angle irons 132 fit into slots 140 formed along the inner periphery of the bracket halves 134 and 136. A pin may also be placed through eyelets 129 and 142 to prevent rotation.

The forgoing description is made in reference to exemplary, preferred embodiments of the invention. However, these embodiments may be modified or altered without departing from the scope of the invention, which is defined and limited solely by the appended claims.

What is claimed is:

1. A method in which a spool wound with continuous pipe for well-related operations is lowered onto a stand, the spool being supported on the stand by at least one axle and receiving rotational power through a coupling between the spool and stand, the method comprising:

withdrawing at least partially a pipe from a bore formed in the at least one axle when lowering the spool onto or removing it from, the stand so that the pipe does not interfere with lowering or removing the pipe from the stand;

extending the pipe through the bore bole when the spool is mounted on the stand so that a first end of the pipe is disposed inside the spool and a second end of the pipe is disposed outside the spool; and coupling either the first or the second end of the pipe to a swivel joint.

2. The method of claim 1 further comprising:

if the swivel joint is connected to the first end of the pipe, coupling to the second end of the pipe a fluid source and coupling the pipe to the stand to prevent relative rotation of the pipe with respect to the stand; and if the swivel joint is coupled to the second end of the pipe, coupling the coiled tubing on the spool to the swivel joint, coupling the first end of the pipe with the fluid source, and coupling the pipe to a rotating part of the stand for rotation with the at least one axle.

3. A stand for supporting a spool wound with continuous pipe of a type used in oilfield service operations, comprising:

a structure supporting a drive coupling member for transmitting rotational power and a pair of axles; and a pipe slidably disposed within a bore formed through one of the pair of axles for communicating fluid, whereby the pipe may be placed in a retracted position and an extended position with respect to the one of the pair of axles.

4. The stand of claim 3, wherein the pipe, when it is in the extended position, is coupled with a non-rotating member of the stand for preventing rotation relative to the stand.

5. The stand of claim 3, wherein the pipe, when it is in the extended position, is coupled wit a rotating member of the stand for rotation with the drive coupling member.

6. A reel assembly for supplying continuous pipe of a type used in oilfield service operations, comprising:

a stand onto which a spool of continuous pipe is lowered;

a drive coupling for transmitting rotational power from the stand to the spool;

an axle for supporting the spool on the stand and disposed for rotation with the spool;

a pipe slidably disposed within a bore formed through the axle for communicating fluid between the continuous tubing wound on the spool and a fluid source, whereby the pipe is retracted to provide clearance for lowering the spool onto the stand, and is extended after lowering the spool onto the stand, with a first end of the pipe disposed inside such spool and an opposite, second end of the pipe disposed outside the stand when extended.

7. The stand of claim 6, further comprising a swivel joint coupled with one of the first and second ends of the pipe.

8. The reel assembly of claim 7 wherein the swivel joint is coupled to the second end of the pipe.

9. The reel assembly of claim 7 wherein the swivel joint is mounted inside the spool and coupled to the first end of the pipe.

10. A reel assembly for supplying continuous pipe of a type used in oilfield service operations, comprising:

a stand onto which a spool of continuous pipe is lowered;

a drive coupling for transmitting rotational power from the stand to the spool;

an axle for supporting the spool on the stand and disposed for rotation with the spool;

a pipe slidably disposed within a bore formed through the axle for communicating fluid between the continuous tubing wound on the spool and a fluid source, whereby the pipe is retracted to provide clearance for lowering the spool onto the stand, and is extended after lowering the spool onto the stand, with a first end of the pipe disposed inside such spool and an opposite, second end of the pipe disposed outside the stand when extended; and a coupling for fixing the pipe's rotation relative to the stand.

11. The reel assembly of claim 10, wherein the coupling prevents the pipe from rotating relative to the stand.

12. The reel assembly of claim 10, wherein the coupling couples the pipe to a rotating member of the stand so that it rotates with the spool.

* * * * *

UNITED STATES PATENT AND TRADEMARK OFFICE

CERTIFICATE OF CORRECTION

PATENT NO. : 6,648,000 B2
DATED : November 18, 2003
INVENTOR(S) : Cain et al.

It is certified that error appears in the above-identified patent and that said Letters Patent is hereby corrected as shown below:

Column 1,
Line 20, please change “contiguous” to -- continuous --.

Signed and Sealed this

Third Day of February, 2004

JON W. DUDAS
*Acting Director of the United States Patent and Trademark Office*